US006578740B1

(12) United States Patent
Hagihara

(10) Patent No.: US 6,578,740 B1
(45) Date of Patent: Jun. 17, 2003

(54) SELF-STANDING BAG CONTAINER EQUIPPED WITH VACUUM AND FLOW RATE CONTROL FUNCTIONS

(76) Inventor: Tadashi Hagihara, 606 Dai2Skyheights, 120 Saiwai-cho, Nishimabashi, Matsudo-shi, Chiba 271 (JP)

( * ) Notice: Subject to any disclaimer, the term of this patent is extended or adjusted under 35 U.S.C. 154(b) by 0 days.

(21) Appl. No.: 09/869,043

(22) PCT Filed: Dec. 22, 1998

(86) PCT No.: PCT/JP98/05803

§ 371 (c)(1),
(2), (4) Date: Jun. 22, 2001

(87) PCT Pub. No.: WO00/37327

PCT Pub. Date: Jun. 29, 2000

(51) Int. Cl.[7] ..... B65D 35/08
(52) U.S. Cl. ..... 222/107; 222/449; 222/547; 222/564
(58) Field of Search ..... 222/92, 107, 421, 222/449, 547, 564

(56) References Cited

U.S. PATENT DOCUMENTS

| | | | | | |
|---|---|---|---|---|---|
| 1,760,773 | A | * | 5/1930 | Penney | 222/99 |
| 2,714,977 | A | * | 8/1955 | Davis | 222/424.5 |
| 3,297,211 | A | * | 1/1967 | Unger | 222/479 |
| 5,005,734 | A | * | 4/1991 | Van Gordon et al. | 222/107 |
| 6,050,451 | A | * | 4/2000 | Hess, III et al. | 222/92 |
| 6,209,754 | B1 | * | 4/2001 | Suzumi | 222/92 |
| 6,273,307 | B1 | * | 8/2001 | Gross et al. | 222/92 |

FOREIGN PATENT DOCUMENTS

| | | |
|---|---|---|
| JP | 55-125091 | 9/1982 |
| JP | 58-179841 | 6/1985 |
| JP | 63-162993 | 6/1990 |
| JP | 10-129683 | 5/1998 |
| JP | 10-152147 | 6/1998 |

* cited by examiner

*Primary Examiner*—Gene Mancene
*Assistant Examiner*—Melvin Cartagena
(74) *Attorney, Agent, or Firm*—Wenderoth, Lind & Ponack, L.L.P.

(57) ABSTRACT

A self-standing type bag-shaped vacuum container has a self-standing container including a wall formed of a soft sheet, a pouring port, and a check valve mounted in the pouring port. The check valve is opened to allow the migration of a content of the container when subjected to a pressure in the pouring direction, but is closed when subjected to a pressure in a filling direction, so that the inside of the container is evacuated. The self-standing container can be optimized for storing beverages or the like which are negatively effected by contact with air, because the content will be oxidized with the air. The vacuum type container will not lose its self-standing property even if the content is reduced, and can stand stably by itself.

8 Claims, 15 Drawing Sheets

SELF-STANDING BAG CONTAINER EQUIPPED WITH VACUUM AND FLOW RATE CONTROL FUNCTIONS

TECHNICAL FIELD

The present invention relates to a self-standing container such as a so-called "stand pouch" which can stand by itself when its bottom is expanded by being filled with a content and, more particularly, to a self-standing container which prevents the immigration of air or the like by blocking the inflow of the air with a check valve and which prevents any discharge of the content even at an accidental impact or the like.

TECHNICAL BACKGROUND

In the prior art, for the storage of beverages that have their taste deteriorated by oxidation, such as wine, sake, whiskey, fruit beverages, and vegetable juices, glass bottles have been used which are sealed with large-sized cork stoppers or screw caps. However, these glass bottles are heavy and brittle so that they are seriously troublesome to handle. It is, therefore, the current practice to use PET bottles made of plastic in place of the glass bottles.

These hard containers, as represented by the PET bottles, are hardly reduced in their own capacities as their contents are reduced. Therefore, the hard containers are highly stationary as containers and can be used as pressure-resisting containers according to their shape. Thus, the hard containers offer a feature in that they can also be used as pressure-resisting containers for carbonated beverages or the like.

Like the glass bottles or the like, however, the hard containers such as the PET bottles will establish cavities as their contents are reduced, and the cavities will be occupied by air so that the contents are oxidized with the air. Therefore, the hard containers are not suited for storing the beverages effected by contact with the air, such as wine, sake, whiskey, fruit beverages, and vegetable juices.

On the other hand, the hard containers always have constant capacities so that they themselves always occupy a constant amount of space, no matter whether or not they have contents. It is easily understood how wasteful this is, if a case in which a container that is filled with a beverage is stored in a refrigerator is imagined. Where a 1 liter container containing 200 cc of water is stored in a refrigerator, a volume of 800 cc of the container occupies the refrigerator as wasted space.

With an increase in consciousness of environmental protection in recent years and, on the other hand, with a view towards getting rid of disposable containers, more inexpensive bag-shaped containers have been employed for rebottling, instead of the PET bottles, especially for home detergents. Most of the bag-shaped containers for these purposes are the self-standing containers called "stand pouches" because they are easily displayed at shops.

Thus, we had an idea that the stand pouch containers are used in placed of the PET bottles, and have made various investigations. We have found out to mount a pouring port in the stand pouch container and to attach a check valve to the pouring port. Then, this check valve is opened to allow the contents to migrate when subjected to a pressure in the direction to pour the contents and is closed when subjected to a pressure in the filling direction.

At this time, especially the upper portion of the inside of the self-standing container formed of a soft sheet is automatically subjected to a vacuum by the downward flow phenomenon due to the gravitational force of the contents. By this vacuum, moreover, the check valve is closed when the pressure is applied in the filling direction of the self-standing container (to suck the contents), so that the container can prevent the intake of air. In other words, this self-standing container can be said to be a so-called "vacuum container having a suction preventing function in the vacuum" for preventing the inflow of air at all times.

Here, it has been found that this self-standing container retains its self-standing property only while it is filled up with the contents. It has also been found that the container has its capacity reduced and loses its self-standing property as the content is reduced, and that a bag-shaped container 200 having lost its rigidity, as shown in FIG. 9, folds midway such that its head collapses, thereby raising a problem in that the bag-shaped container falls down and is hard to handle.

The present invention has an object to provide both the so-called "self-standing type bag-shaped vacuum container" capable of preventing the immigration of air at all times and a stand pouch type container which retains the advantage of flexibility and high capacity efficiency, as belonging to that of the prior art, and which has a self-standing property when the content is reduced as is absent in that of the prior art.

In the hard container of the prior art, such as a glass bottle or a PET bottle, on the other hand, the pouring rate could always be controlled to be constant by gripping the container firmly with the hands of a user and by controlling the tilting angle of the bottle.

Here, the hard container of the prior art is not or slightly deformed when gripped with the hands, and no internal pressure is established in the container so that the content is not vigorously discharged, but is poured out.

Recently, however, a bag-shaped container having a cylindrical pouring port has been used especially as a beverage container. The bag-shaped container is made flexible and foldable, and has its entire capacity reduced as the content is reduced. Therefore, this container is able to reduce the amount of waste by folding and disposing of it.

However, the soft container, such as the bag-shaped container described above, is flexible so that an internal pressure is easily established, when the container body is squeezed, to discharge the content vigorously. This characteristic is a defect intrinsic to a soft container body of the bag-shaped container or the like. Therefore, when the content is transferred from the bag-shaped container to another container, the content is poured not by squeezing the container body of the bag-shaped container, but by gripping and tilting the outer edge of the container body, by applying the pouring port to the inlet port of the container without spilling the transferred content, and by pushing the container body to pour the content. However, this handling is so troublesome that the content will be vigorously discharged, thereby causing a spill unless special care is taken. On the other hand, a fall has to be feared at all times so long as the soft container stands by itself.

Therefore, the present invention has been contemplated to solve the above-specified problems and has an object to provide a bag-shaped container which is freed from any vigorous discharge of the content even if its body is carelessly squeezed and which can take the place of the hard container of the prior art, such as the glass bottle or the PET bottle.

SUMMARY OF THE INVENTION

According to the invention, more specifically, there is provided a self-standing type bag-shaped vacuum container comprising a self-standing container including a wall formed of a soft sheet and a bottom made expandable when filled with a content, so that it can stand by itself, a pouring port disposed in the end portion of the self-standing container formed of the soft sheet, and a check valve mounted in the pouring port. The check valve is opened to allow the migration of the content when subjected to a pressure in the pouring direction, but is closed when subjected to a pressure in a filling direction, so that the inside of the container is evacuated by the vacuum which is established by the weight of the content in the self-standing container formed of the soft sheet.

According to the invention, there is provided a self-standing bag-shaped container comprising a wall formed of a soft sheet, and a pouring port so that it can stand by itself when its bottom is expanded by filling it with a content. A check valve is disposed in a cylindrical member forming the pouring port for preventing the backflow of air as the content is discharged. The container is evacuated at its upper portion, when the container is placed upright after the content is discharged, by the downward migration of the remaining content due to gravitational force.

Moreover, the check valve has a structure in which a domed head has a cut that is opened when a pressure is applied in the pouring direction, to allow the migration of the content, but is closed, when a pressure is applied in the filling direction, to prevent the inflow of air or the like. Alternatively, outward folds are formed to extend downward from the pouring port to the self-standing container formed of the soft sheet.

In addition, the self-standing bag-shaped container further comprises a joint structure for jointing a sheet member forming the bag-shaped container body and a cylindrical member forming the pouring port, in that the cylindrical member is inserted into a heat-shrinkable first cylindrical sheet so that these two members are jointed by heat-shrinking the first cylindrical sheet. The container also comprises a second cylindrical sheet including two layers of a resin layer fusible to the sheet member on its outer side jointed in the lower portion of the first cylindrical sheet, and an infusible resin layer on the inner side which is fused to the sheet member.

Moreover, the container further comprises a flow velocity control mechanism including a flow velocity control unit having a vent hole for communication with the container body between the container body and the pouring port, to eliminate the flow velocities of the content in the inflow direction when the content flows into the flow velocity control unit from the inside of the container body through the vent hole.

Still moreover, the container further comprises a flow velocity control mechanism including a plurality of vent holes opposed to each other in a flow velocity control unit so that the content flowing into the flow velocity control unit may impinge upon itself to offset the flow velocity in the inflow direction.

Furthermore, the container further comprises a flow velocity control mechanism including a wall disposed in a flow velocity control unit and intersecting the inflow direction from a vent hole at a right angle so that the content flow may be impinged, when the content comes from the inside of the container body into the flow velocity control unit, upon the wall, to eliminate the flow velocity in the inflow direction.

The self-standing container such as the stand pouch of the invention has the construction thus far described so that it can be optimized for storing not only wine, sake or whiskey, which are effected by contact with air because they will be oxidized with the air, but also fruit beverages, vegetable juices or other beverages. The invention can provide a vacuum type container which will not lose its self-standing property even if the content is reduced and can stand stably by itself.

It is quite natural for the container like the stand pouch to be used not merely as a disposable container, but as a self-standing container in place of the bottle type container which has a pouring port and can be reused. Where the container is used as the self-standing container, no matter how much it contains. The container can be kept in the upright position with its bottom being expanded. When the container is not used, on the other hand, it can be easily stored in a flat bag shape by folding the bottom.

It is also possible to provide such a soft container represented by the bag-shaped container provided with the flow velocity control mechanism for preventing the content from being vigorously discharged by internal pressure generated when the container body is squeezed.

BRIEF DESCRIPTION OF THE DRAWINGS

FIG. 3(*b*) is a longitudinal section of the FIG. 3(*a*);

DETAILED DESCRIPTION OF THE INVENTION

The invention will be described in connection with its embodiments with reference to the accompanying drawings.

Figure 1:
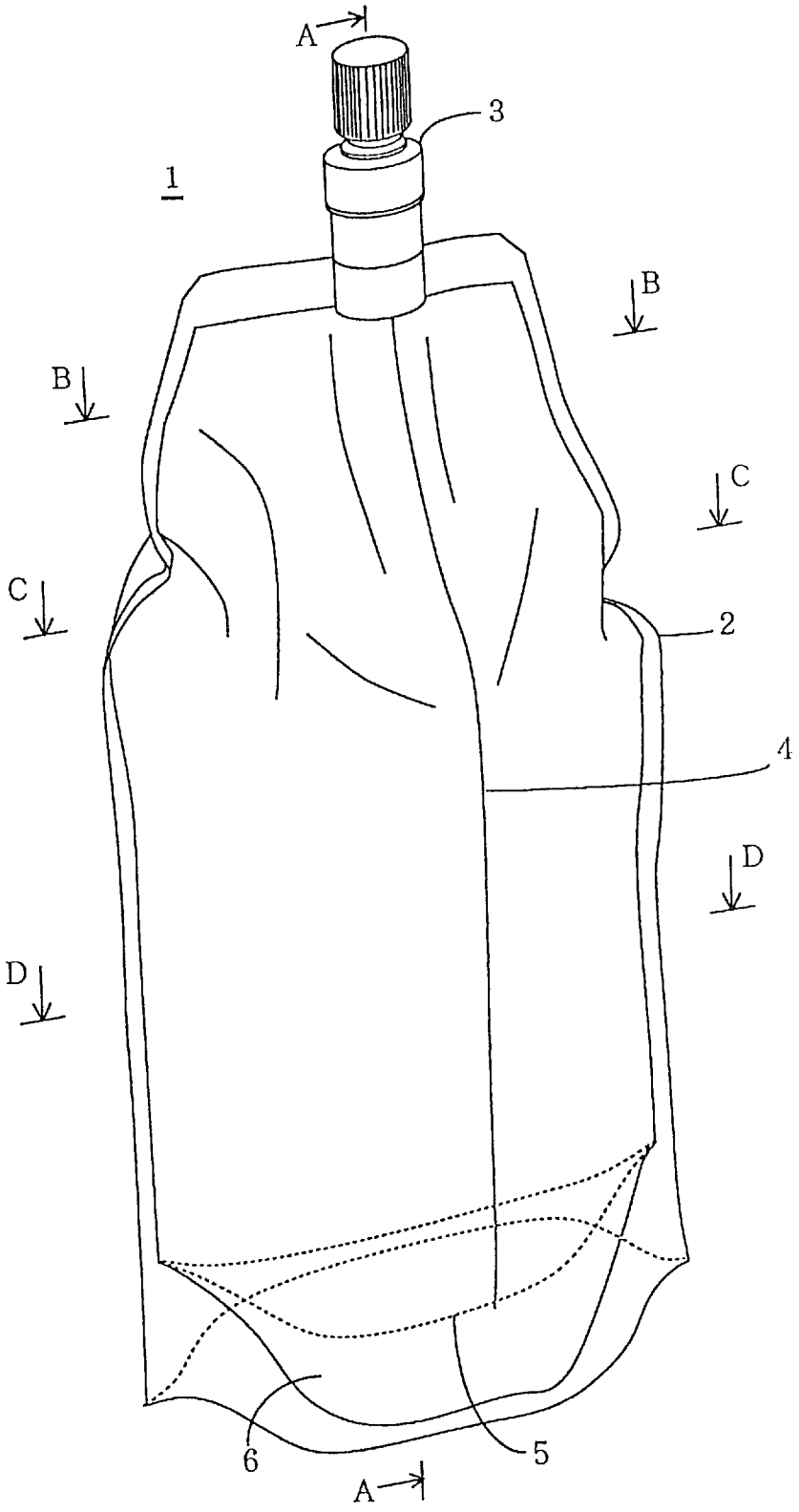
FIG. 1 is a perspective view showing a first embodiment of such a self-standing container of the invention which prevents the air from migrating thereinto.

FIG. 1 is a perspective view showing a first embodiment of the invention. A self-standing container 1 is formed of a soft sheet by an ordinary method into a stand pouch and is constructed by forming a pouring port 3 at an upper end of a container body 2 of the soft sheet portion. Further, numeral 4 designates folds which are formed to bulge from the container body 2 and to start downward from the lower end of the pouring port 3.

In FIG. 1, the material for the container body 2 can be selected from a plastic sheet, a metallic sheet or a composite sheet composed of the former sheets. The plastic sheet is exemplified by polyethylene, polypropylene, polyester, polycarbonate or a nylon resin. The container body 2 is formed by using those soft sheet or composite sheet, by applying the two material sheets(or the body side wall sheet members) and heat-sealing their peripheries over a predetermined width, and by fusing those sheets.

Here, the bottom of the container body 2 is fused by intervening a bottom seat member 6 folded downward. When the container body 2 is filled with a content, therefore, the turn-up portion 5 of the bottom is opened to widen the bottom sheet member 6 thereby forming the bottom of the container. Therefore, the container body 2 stands by itself without any support when it is placed in that state on a table or the like.

Figure 2A:
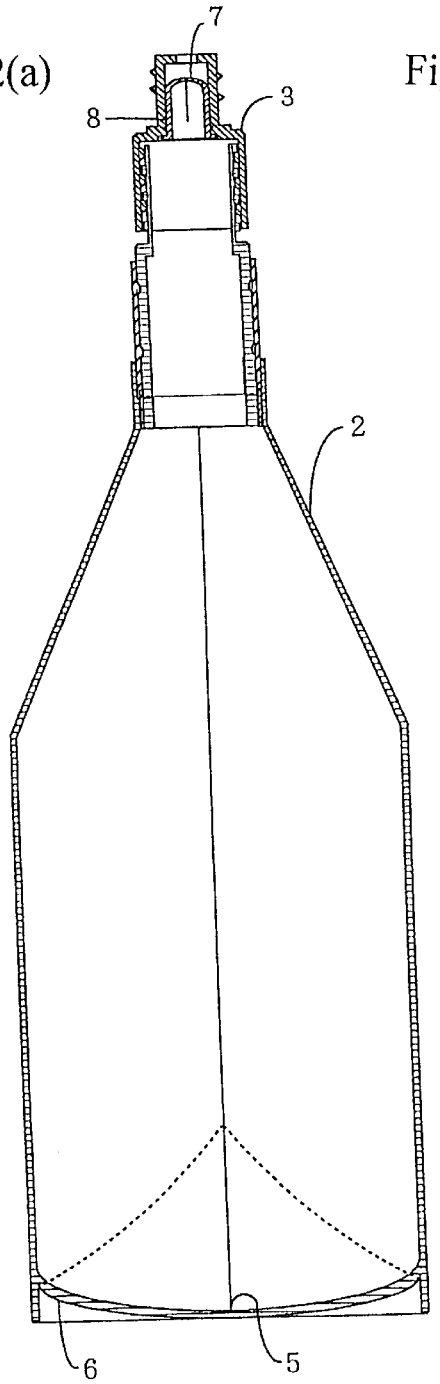
FIGS. 2(*a*) and 2(*b*) are longitudinal sections of the first embodiment.
Figure 2B:
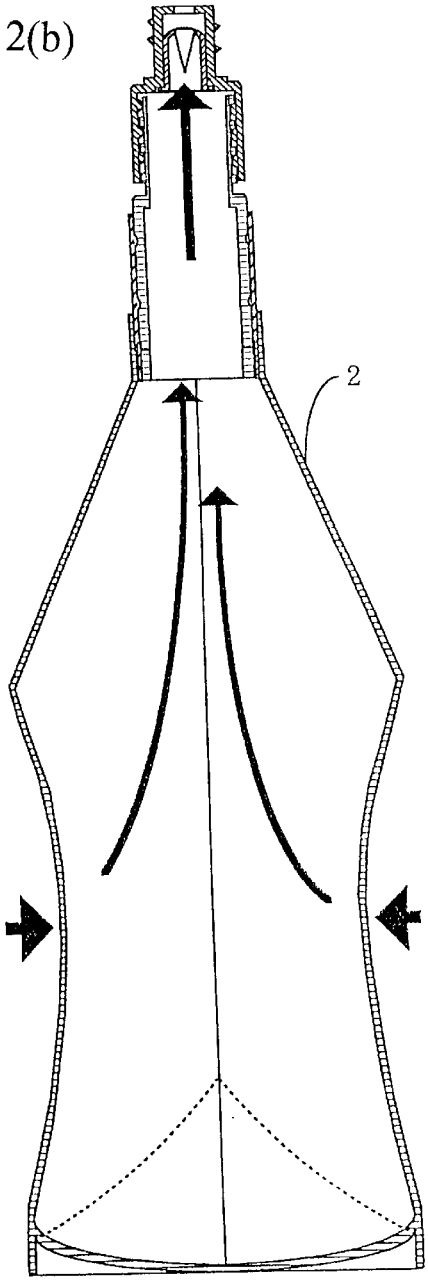

The pouring port 3 is provided therein with a check valve 7, as shown in FIG. 2(*a*). This check valve 7 is formed of an elastic material such as rubber shaped into a cylindrical structure, in which a cut 8 extending to the cylindrical side wall is formed in the domed head. When the container body 2 is manually squeezed at its trunk portion with an internal pressure, as shown in FIG. 2(*b*), the pressure is applied in the pouring direction to open the cut 8 so that the content is released by the opened communication.

Simultaneously, as the container body 2 is then released to remove the internal pressure, the cut 8 is closed to block the inflow of air by the elasticity (or the restoring force) of the check valve 7 itself At this time, a vacuum is established in the upper portion of the self-standing container 1 as a result of the downward flow phenomenon of the content due to the force of gravity. In response to this vacuum, therefore, the check valve 7 can be closed to block the immigration of the air completely. By thus providing the check valve 7, it is possible to reliably prevent the content in the self-standing container 1 from being oxidized with the air.

On the other hand, the vacuum in the upper portion of the container has an effect of enhancing the separation between the content or liquid and the air dissolved in the liquid according to their weight ratio. When the container restores its self-standing position after the content is discharged, the dissolved air in the liquid is sucked as bubbles upward in the container by the standing impact. Moreover, the rising air is stored just below the check valve so that a higher oxidation preventing effect can be obtained if the container is slightly compressed again to expel the air.

Here, the check valve 7 should not be limited to the aforementioned shape, but can be basically exemplified by any valve type, such as a reed valve type, a poppet valve type, a pinch valve type or a check ball, if it belongs to a valve type called a "check valve" or "one-way valve". Moreover, these valves are suitably selected according to not only the restoring spring force, or the elastic force but also the properties of the content.

Figure 3A:
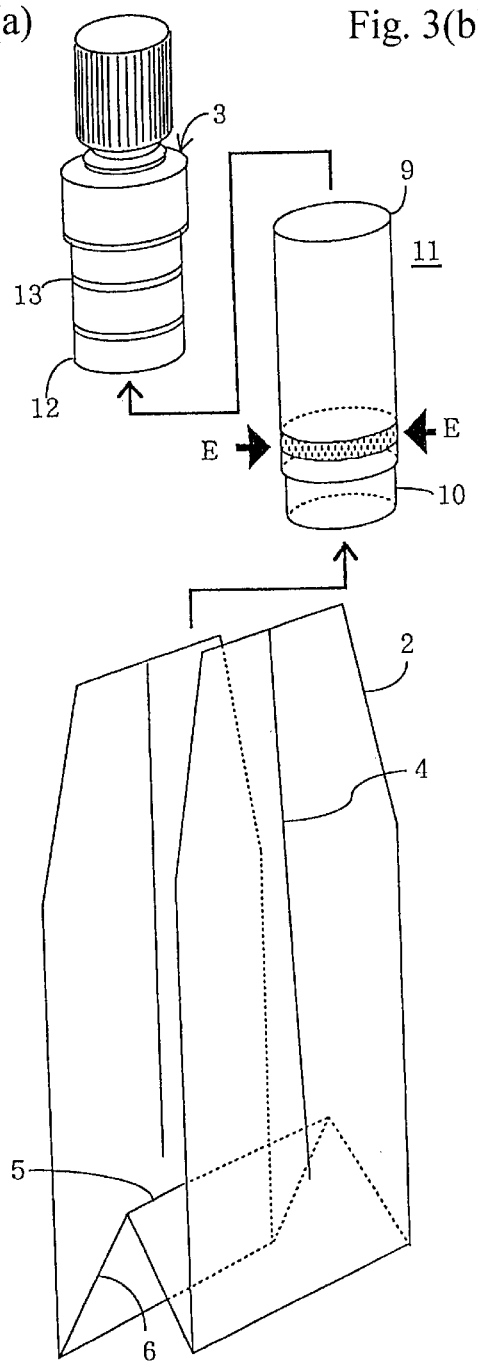
FIG. 3(*a*) is a diagram explaining a procedure for manufacturing the self-standing container of the invention.
Figure 3B:
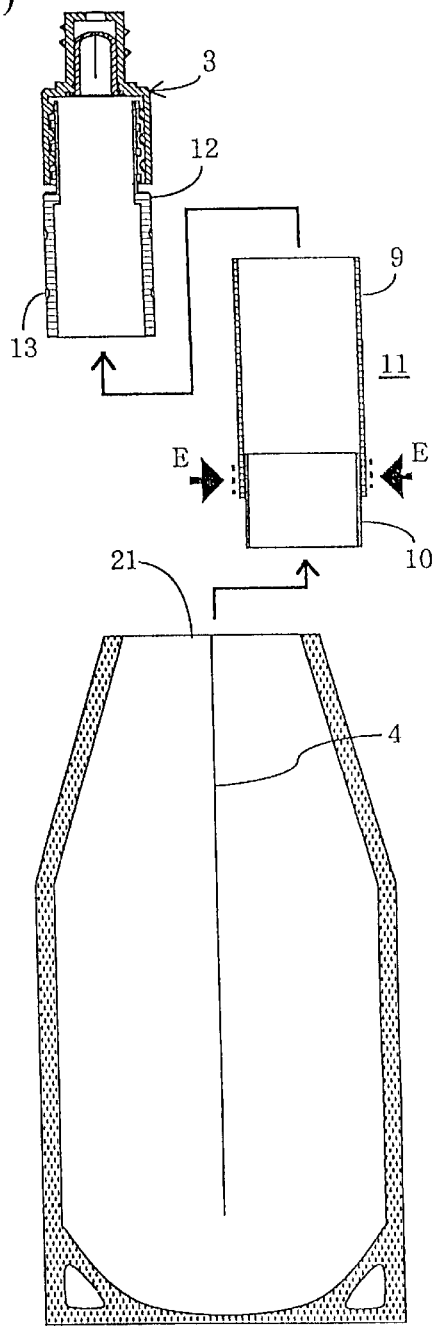
Figure 4A:
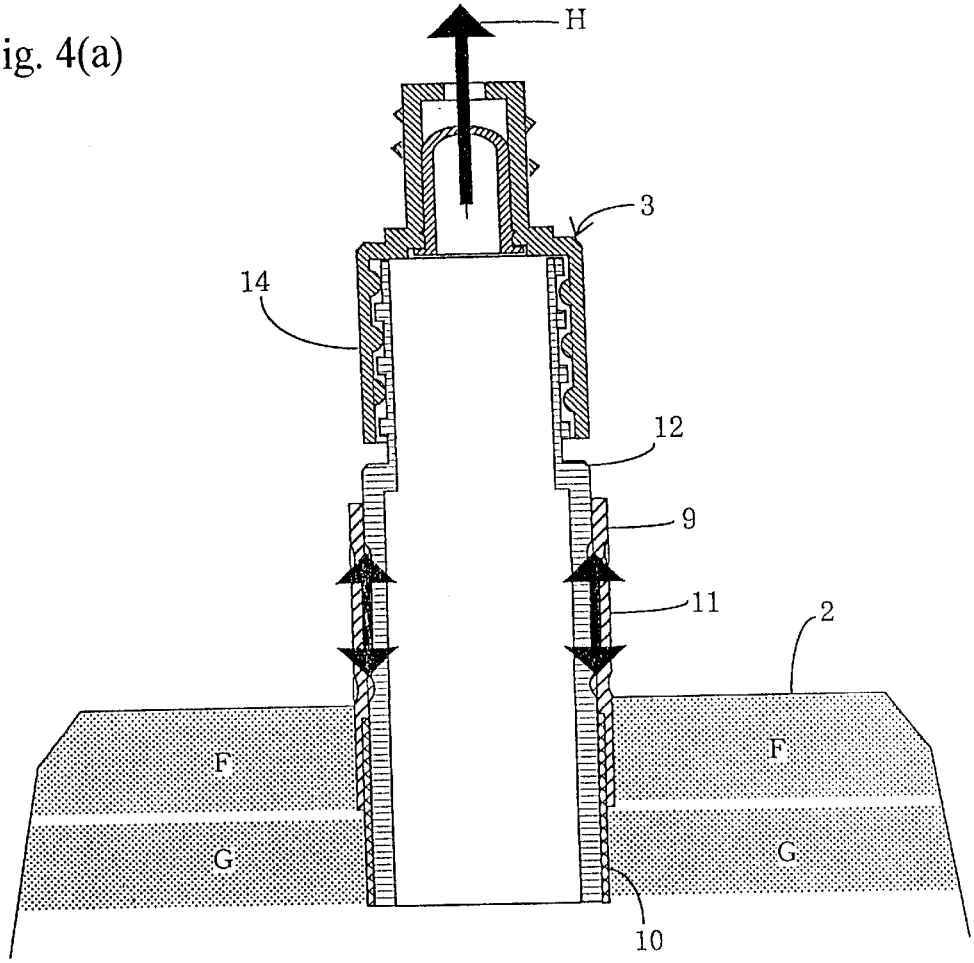
FIGS. 4(*a*) and 4(*b*) are sectional views showing an essential portion in a jointed state.
Figure 4B:
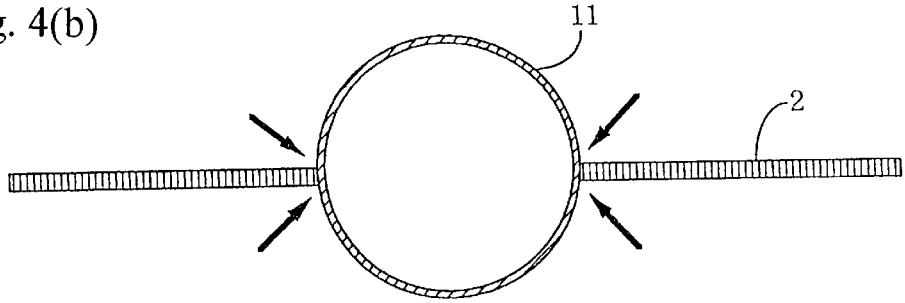

Next, the joint of the pouring port 3 and the container body 2 is shown in FIGS. 3(*a*) and (*b*) and FIGS. 4(*a*) and (*b*).

First of all, the folds 4 are formed from the upper end of the container body 2, i.e., from the formed portion of the pouring port 3 toward the bottom of the container body 2. These folds 4 are desirably formed by folding the material sheet in advance. The container body 2 is formed in advance by the aforementioned method into the bag shape while leaving an opening 21 at the upper end. To an inner side of a lower end of a heat-shrinkable tube 9, there is then fused a two-layered resin tube 10 which has an infusible material arranged on the inner side and a fusible material on the outer side in a direction E such that the resin tube 10 protrudes to a desired extent from the lower end of the heat-shrinkable tube 9, thereby forming a joint tube 11.

Next, this joint tube 11 is fused to the container body 2. Then, the lower portion of the joint tube 11 is inserted into the upper end opening 21 of the container body 2, to fuse the container body 2 and the heat-shrinkable tube 9 of the joint tube 11, and the container body 2 and the resin tube 10 of the joint tube 11 separately at F and G. At this time, the joint tube 11 is made of a thin tube so that it is easily flattened when clamped. As a result, the joint portions(as indicated by arrows in FIG. 4(*b*)) between the joint tube 11 and the container body 2 can acquire a necessary and sufficient fused strength.

The pouring port 3 is provided at its lower portion with a joint portion 12 to the container body 2. The joint portion 12 is provided with a suitable number (e.g., two in FIGS. 3(*a*) and (*b*)) of grooves 13. Moreover, the joint portion 12 is inserted into the joint tube 11, and this joint tube 11 is heated. Then, the heat-shrinkable tube 9 of the joint tube 11 shrinks to be fastened to the joint portion 12 of the pouring port 3. At this time, the heat-shrinkable tube 9 having shrunken enters the grooves 13 of the joint portion 12 thereby performing a reliable action as a stopper. Therefore, the grooves 13 result in a higher stopping effect if they are greater in number and deeper.

Where the self-standing container 1 thus constructed is used by using the pouring port 3 as a grip, as shown in FIG. 4(*a*), a pulling-up force (or the gravitational force to be applied to the container body filled with the content) H is received mainly by the joint portion 12 of the pouring port 3 and the heat-shrinkable tube 9, and is dispersed from the heat-shrinkable tube 9 and the resin tube 10 to the fused portion of the container body 2.

In the prior art, the joint portion of the container of this kind between the soft bag-shaped portion and the hard cylindrical portion does not provide sufficient joint strength, because the stress is concentrated at that joint portion which breaks the joint portion easily. This particular problem has resulted in the failure of the prior art to provide a bag shape having a large capacity according to the structure. According to the joint structure in the self-standing container of the present invention, however, the stress can be reliably dispersed to prevent the breakage of the joint portion.

Figure 5A:
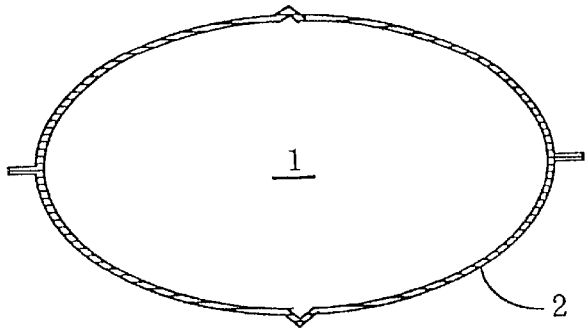
FIGS. 5(*a*), 5(*b*) and 5(*c*) are transverse sections of the individual portions of the container body while the container is being filled with a content.
Figure 5B:
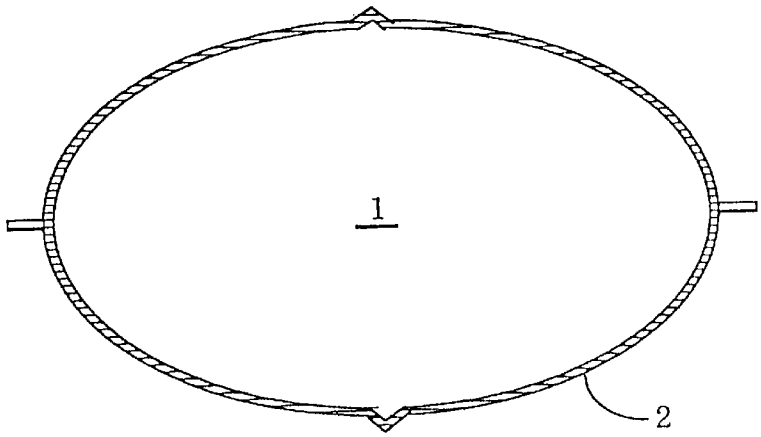
Figure 5C:
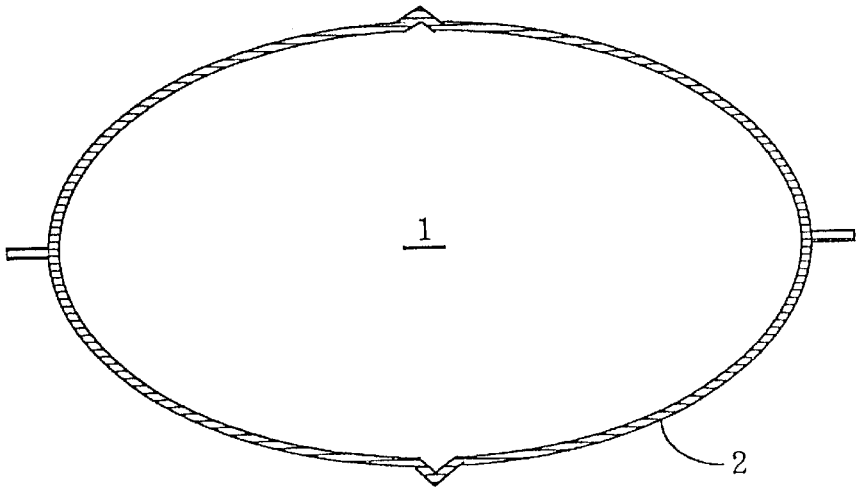

The individual portions of the container body 2, as taken along lines B—B, C—C and D—D of FIG. 1, where the self-standing container 1 thus constructed is filled with the content (e.g., a liquid such as water) are presented in transverse sections in FIGS. 5(*a*), (*b*) and (*c*), respectively.

After the container body 2 was squeezed in the manner shown in FIG. 2(*b*) to pour the content, it is released from its squeezing force. Then, the content flows down to the bottom (i.e., the downward flow phenomenon) by its own weight, but the air is not permitted into the container body 2 by the action of the check valve 7. As a result, the content and the inner face of the container body 2 come into a closely contacting state so that a vacuum is established in the upper portion of the inside of the container body 2. Specifically, in the container of the prior art, which has a hard outer structure to have little deformation and is opened at its discharge port, allows, when inclined to discharge the content, air corresponding to the discharged capacity to flow thereinto. On the contrary, the container body 2 is made soft such that it is deformed to have its capacity reduced with the discharge of the content. Therefore, no air flows into the container.

When this container stands erect, however, the content is concentrated in the lower portion of the container, whereas the upper portion of the container has its capacity reduced as the content leaves the upper portion. It is thought that the content residing in the upper portion is subjected to both the downward force of its own weight and the force pulled from the lower portion by the surface tension so that the internal pressure from the lower portion becomes more negative as the content comes the closer to the check valve.

Figure 6A:
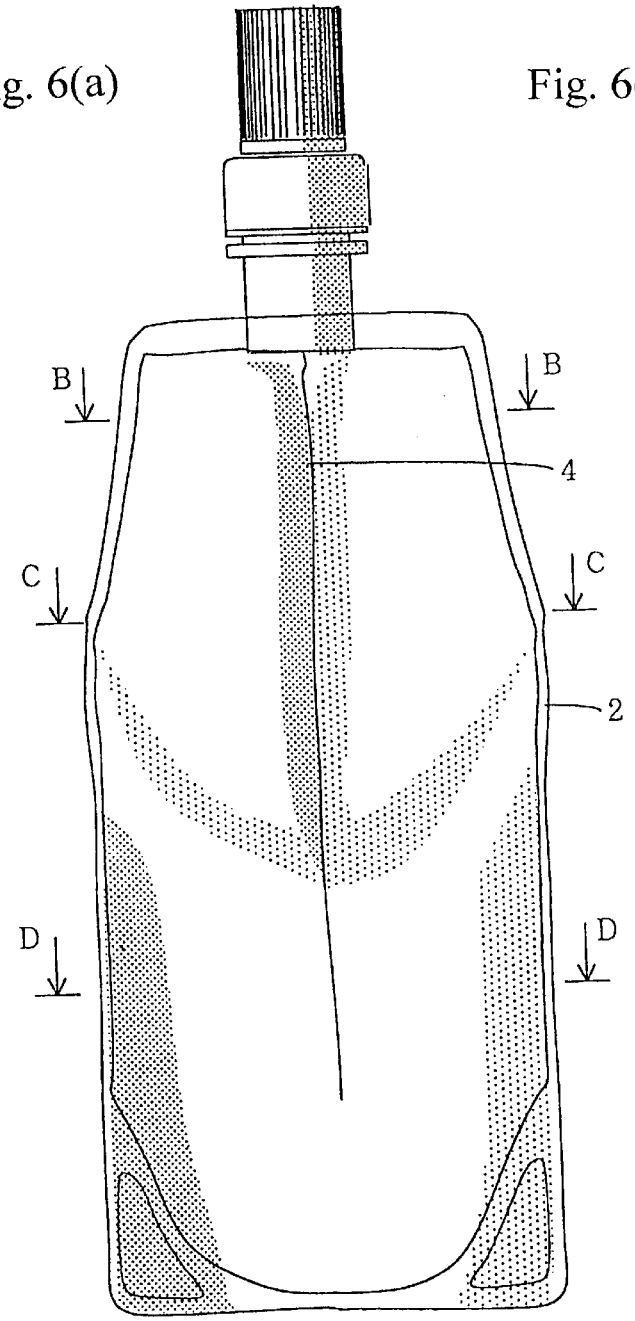
FIGS. 6(*a*) and 6(*b*) are a front elevation and a side elevation of the self-standing container, respectively, while the content is being reduced.
Figure 6B:
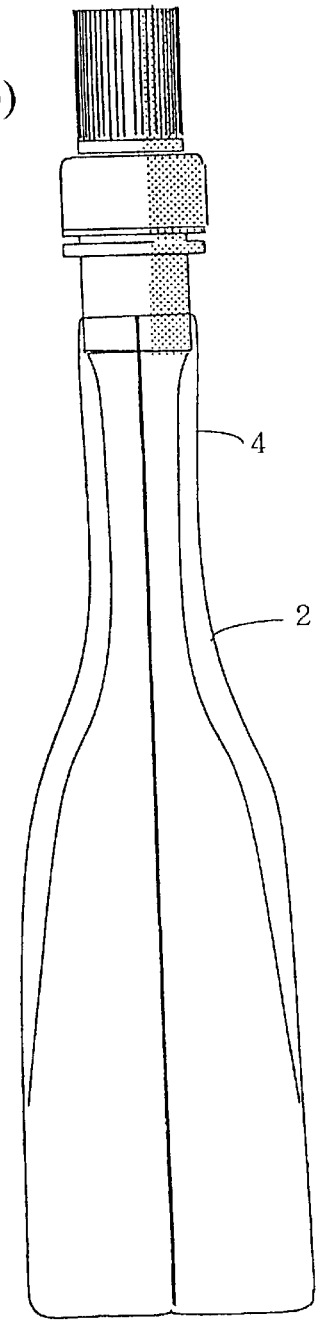
Figure 7A:
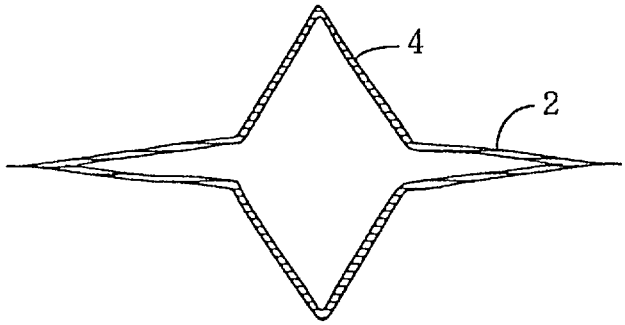
FIGS. 7(*a*), 7(*b*) and 7(*c*) are sectional views of the individual portions of the container body while the content is being reduced.
Figure 7B:
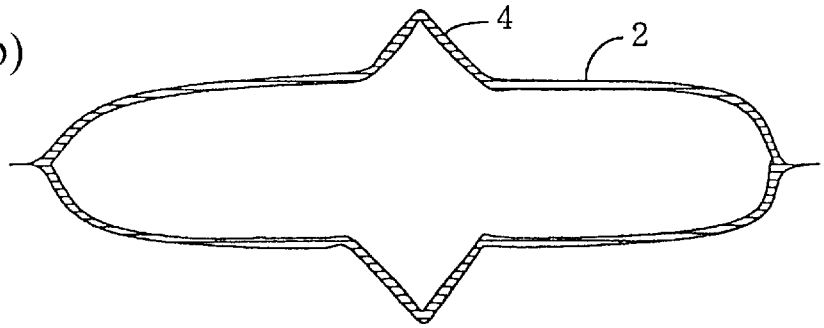
Figure 7C:
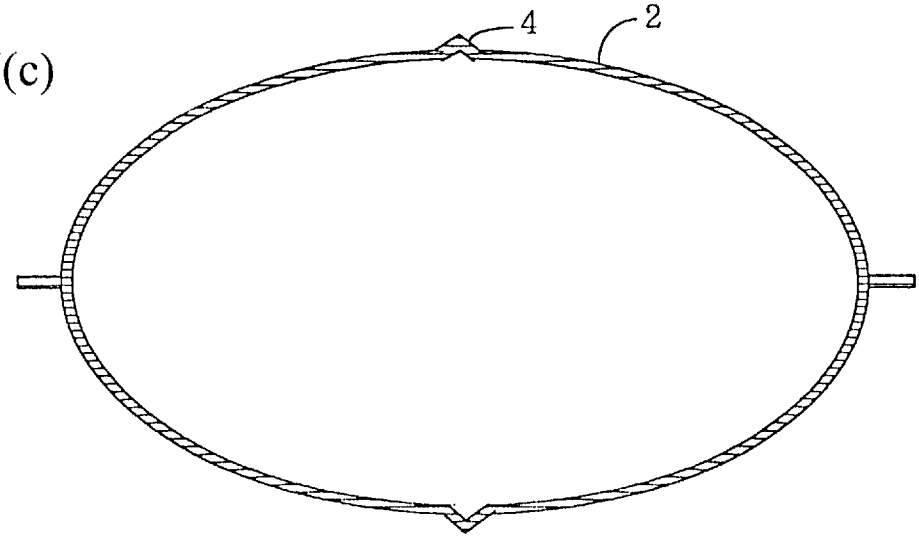

When the content is discharged, the self-standing container 1 becomes thinner from its upper portion, as shown in FIGS. 6(*a*) and (*b*). The transverse sections, as taken along lines B—B, C—C and D—D of FIG. 6(*a*), of the individual portions of the container body 2 in a case of a discharge of about 50%, for example, are presented in FIGS. 7(*a*), (*b*) and (*c*). As such, an upper portion of the container body 2 has the least content, and a square pole is more clearly formed the by the folds 4 to prevent the container from being bent in the thickness direction. Therefore, the square (liquid) pole created by the folds 4 prevents the container body 2 from falling down.

Figure 8A:
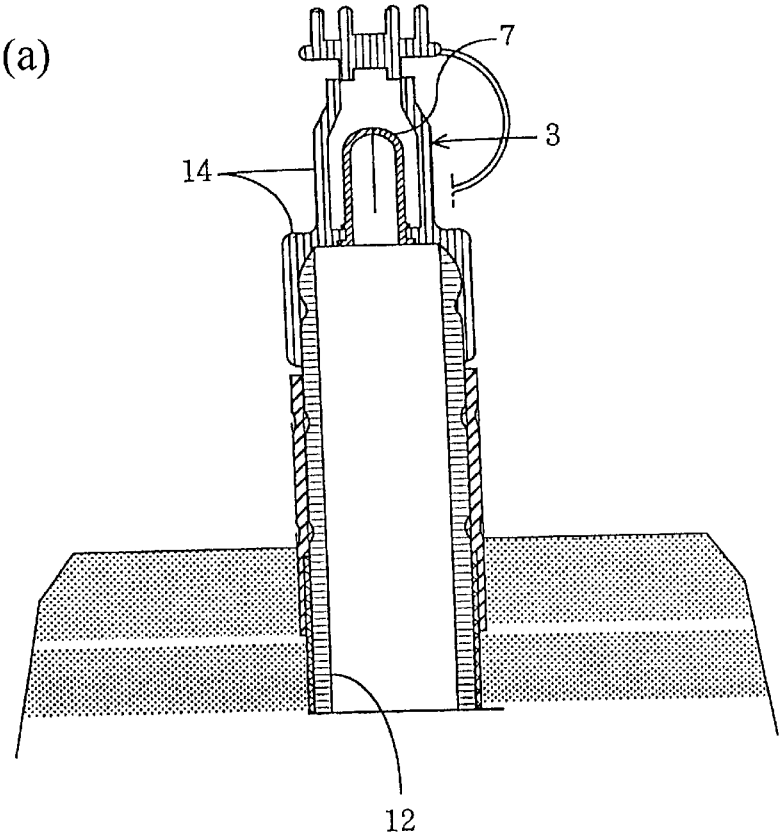
FIGS. 8(*a*) and 8(*b*) are sectional views showing an essential portion of another embodiment and a sectional diagram showing a container like a stand pouch of the prior art.
Figure 8B:
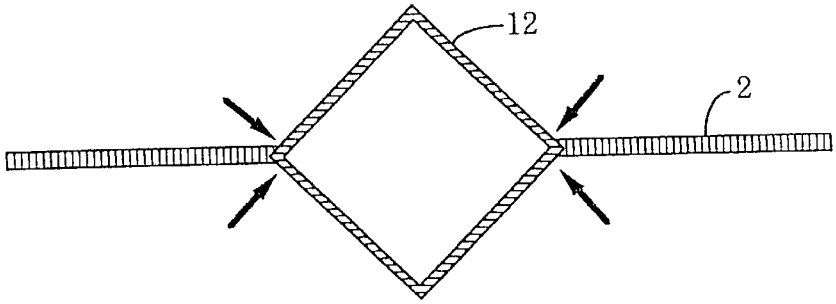
Figure 9:
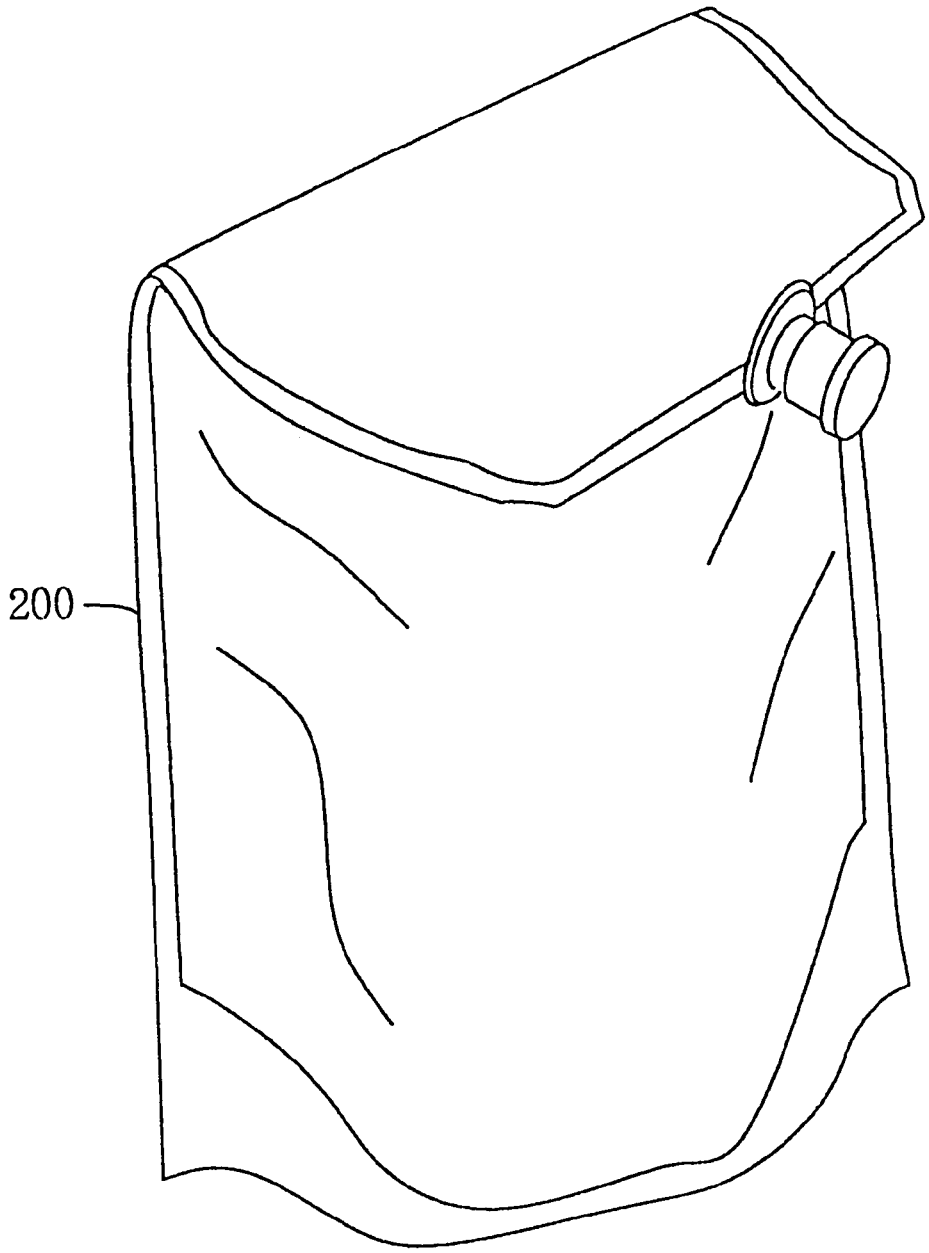
FIG. 9 is a front elevation showing the exterior of one embodiment of the container provided with a flow velocity control mechanism of the invention.
Figure 10:
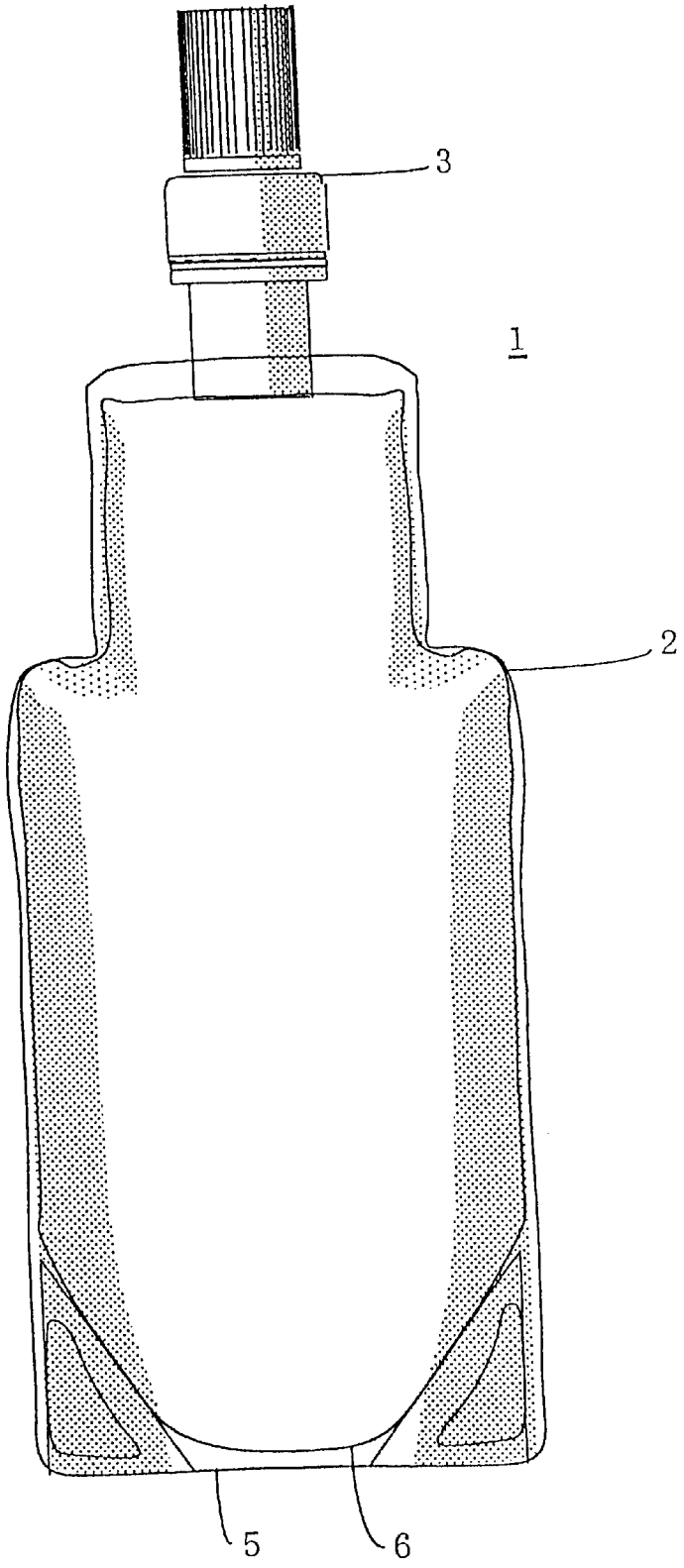
FIG. 10 is a schematic diagram showing the construction of the parts of FIG. 9.

FIGS. 8(*a*) and (*b*) show another construction example of the individual portions of the self-standing container 1 of the invention. In the pouring port 3 of the foregoing embodiment, more specifically, a joint between an enclosure 14 of the check valve 7 and the joint portion 12 is effected by a screw. In FIG. 8(*a*), the joint is exemplified as a press-fit type. In FIG. 8(*b*), on the other hand, the lower portion of the joint portion 12 is formed into a square section. By this square section, the opening angle of the joint portion (as indicated by arrows in FIG. 8(*b*)) between the heat-shrinkable tube 9 or the resin tube 10 and the container body 2 is made obtuse so as to make the possibility of breakage less likely to occur. It is further possible to expect an effect of promoting the action of the folds 4 of the container body 2.

The section of the lower portion of the joint portion 12 should not be limited to the aforementioned circular or square shape, but can be exemplified by any other shape, including an elliptical shape or an elliptical shape having two longitudinal ends of an acute angle and can be suitably determined according to the size or application of the container.

Here, the self-standing container 1 of the invention can be folded for storage like the ordinary container such as the stand pouch, if it is not filled with the content, so that the container 1 does not waste any space for its storage. Further, the container 1 can be used many times if it is cleaned.

Figure 11A:
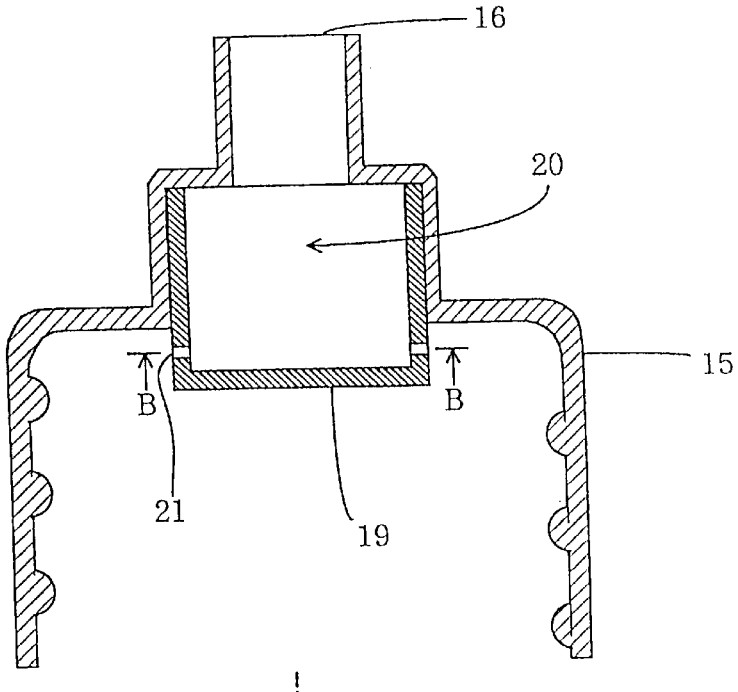
FIG. 11 is a schematic diagram showing the construction of a pouring port.
Figure 11B:
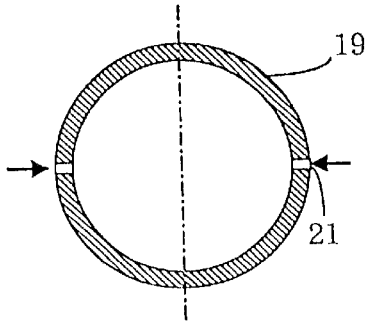
Figure 11C:
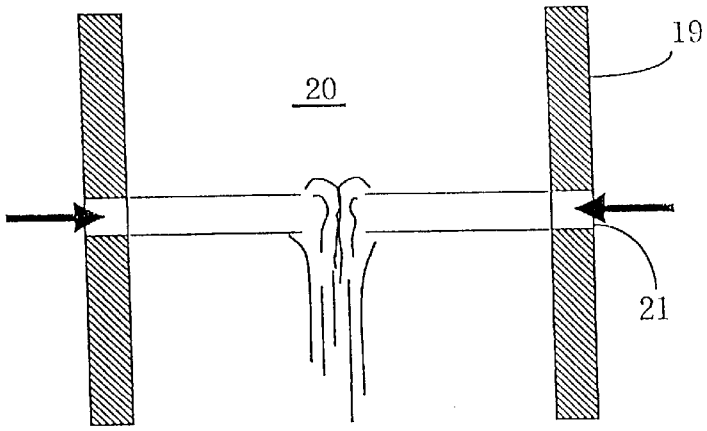

FIGS. 11(*a*) to 14(*d*) show a second embodiment of a self-standing bag-shaped vacuum container of the invention.

The construction of the container body other than the following flow velocity control mechanism is not different from the aforementioned container of the first embodiment. Therefore, the description of the flow velocity control mechanism features the present embodiment.

FIGS. 11(*a*) and (*b*) show a first embodiment of the flow velocity control mechanism of the present invention. FIG. 11(*a*) presents a longitudinal section, and FIG. 11(*b*) presents a sectional view B—B of an essential portion. In a screw cap 15, there is fitted a cup-shaped member 19 having a bottom forming a flow velocity control unit 20. The cup-shaped member 19 protrudes at its lower portion into the joint portion 12 and is provided in its side wall near the bottom with vent holes (passages) 21 communicating with the container body 2. These vent holes 21 are formed symmetrically with respect to a longitudinal section extending through the center of the cup-shaped member 19, as shown in FIG. 11(*b*).

FIG. 11(*c*) is a conceptional diagram illustrating the principle of the flow velocity control of the invention. Specifically, the content which flows (or the liquid flows) from the vent holes 21 is caused to impinge upon itself in the vicinity of the center of the flow velocity control unit 20 in the cup-shaped member 19, for example, by the internal pressure which is generated by squeezing the container body 2. As a result, the flow velocities offset each other to zero so that the content naturally drops towards the bottom (as shown in FIG. 11(*c*)) of the cup-shaped member 19. It is this flow velocity that causes the content to spurt vigorously from the pouring port 3 when the container body 2 is squeezed. It is, therefore, a principle of the invention to prevent the vigorous spurts by lowering that flow velocity.

Figure 12A:
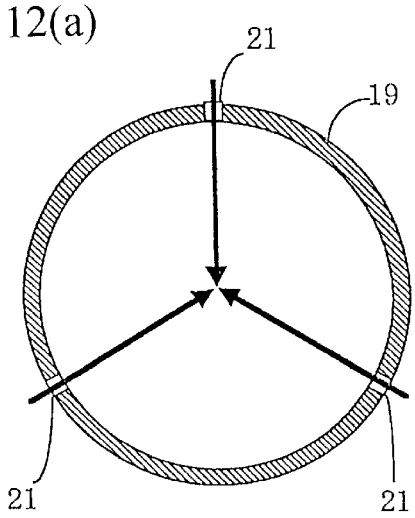
FIGS. 12(*a*) and 12(*b*) are sectional views showing an essential portion of a flow velocity control structure, and FIG. 12(*c*) is a conceptional diagram showing principle of the flow velocity control structure.
Figure 12B:
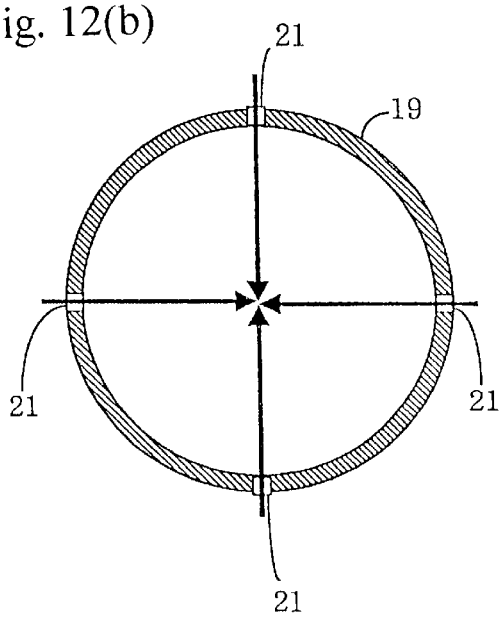
Figure 12C:
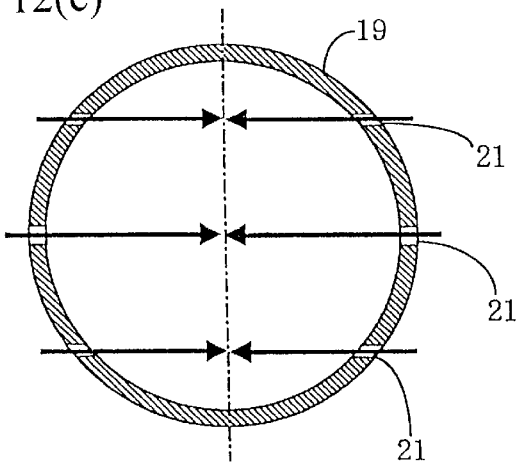
Figure 13A:
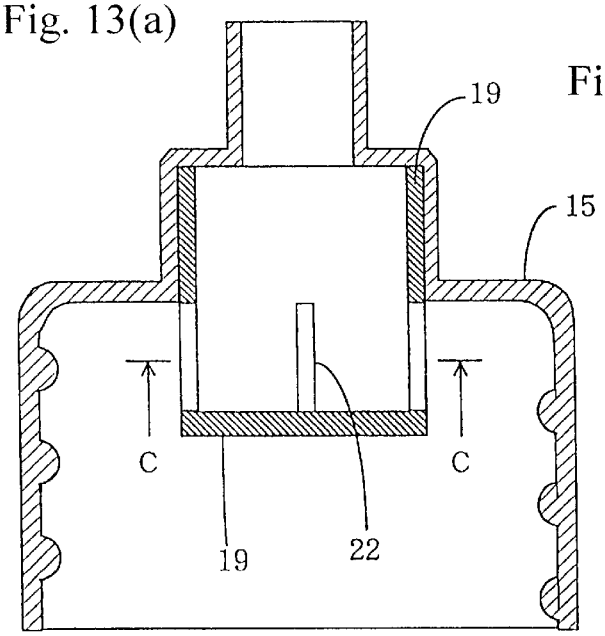
FIGS. 13(*a*), 13(*b*), 13(*c*) and 13(*d*) are schematic diagrams showing example of the arrangement of the vent holes.
Figure 13B:
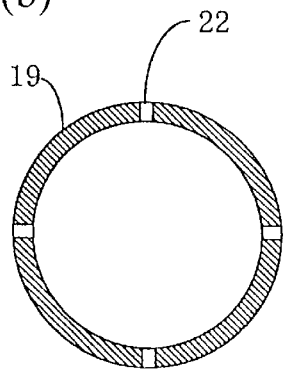
Figure 13C:
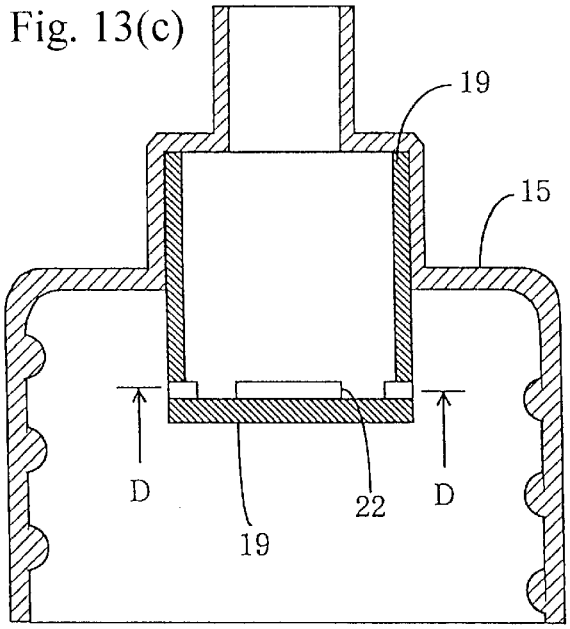
Figure 13D:
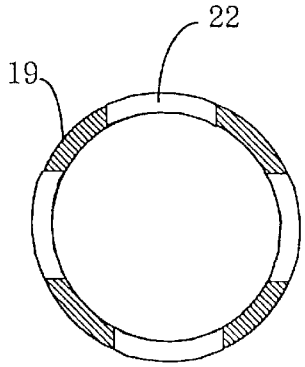
Figure 14A:
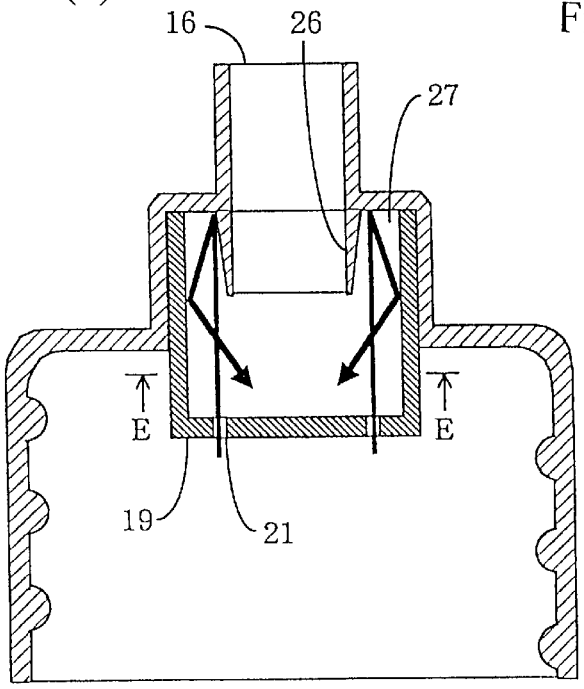
FIGS. 14(*a*) and 14(*b*) are sectional diagrams showing an essential portion of a second embodiment, and FIGS. 14(*c*) and 14(*d*) are sectional diagrams showing an essential portion of a third embodiment.
Figure 14B:
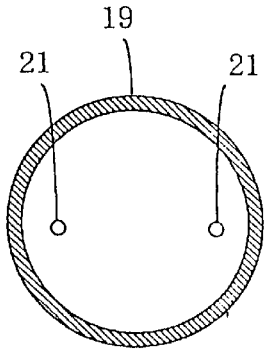
Figure 14C:
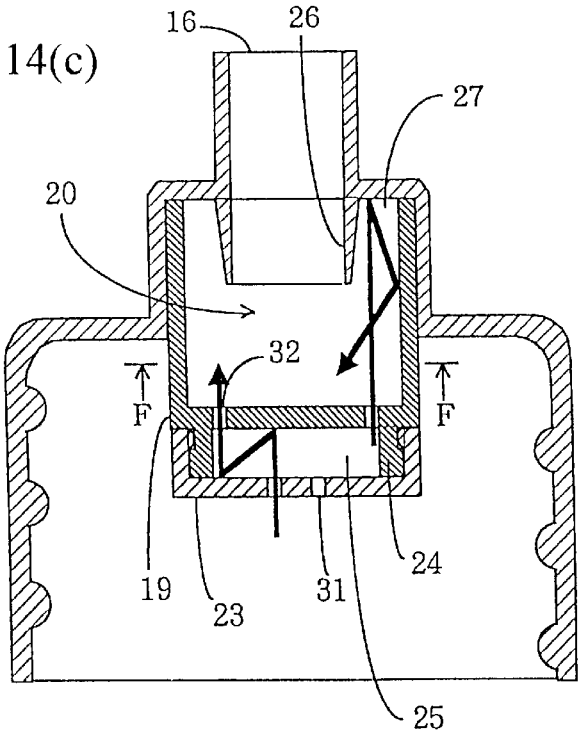
Figure 14D:
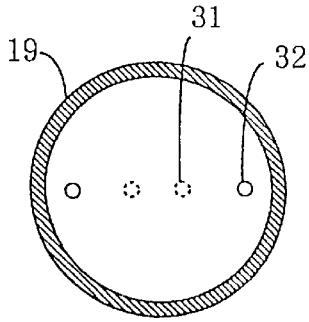

FIGS. 12(*a*), (*b*) and (*c*) is a conceptional diagrams illustrating examples of arrangements of the vent holes 21. In FIGS. 12(*a*) and (*b*), more specifically, there are shown types in which the content flows in three or four directions and impinges at the center of the flow velocity control unit 20. In FIG. 12(*c*), there is shown a type in which three pairs of vent holes 21 are formed symmetrically with respect to the longitudinal section extending through the center of the cup-shaped member 19 so that the flow from the opposed vent holes 21 may impinge head-on upon each other.

The number of the vent holes 21 should not be limited to that shown in FIGS. 12(*a*), (*b*) and (*c*) but may be any number if they are effective to cause the content to impingement at the center of the cup-shaped member 19 or head-on upon each other. It is, however, essential that the number and diameters of the vent holes 21 are well balanced in total (of the effective opening area) with an opening area of a pouring nozzle 16.

FIGS. 13(*a*), (*b*), (*c*) and (*d*) present conceptional diagrams showing second and third embodiments of the flow velocity control mechanism. In FIGS. (a) and (b) , the vent holes are exemplified by longitudinal slits 22. In FIGS. 13(*c*) and (*d*), the vent holes (passages) are exemplified by transverse slits 22. In these cases, too, the slits 22 can be arranged as shown in FIGS. 12(*a*), (*b*) and (*c*). It is, like the foregoing embodiment, essential that the number and opening area of the slits 22 are well balanced in total (of the effective opening area) with the opening area of the pouring nozzle 16.

FIGS. 14(*a*), (*b*), (*c*) and (*d*) present conceptional diagrams showing fourth and fifth embodiments of the flow velocity control mechanism. In FIG. 14(*a*), numeral 21 designates the vent holes, and numeral 26 designates a cylindrical member. FIG. 14(*b*) presents a sectional diagram of E—E. In FIG. 14, the cylindrical member 26 extends into the cup-shaped member 19, and the content flows from the vent holes 21 toward a gap 27 between the cylindrical member 26 and the side wall of the cup-shaped member 19. The content having impinged upon the ceiling to have a zero flow velocity in the inflow direction fills up the flow velocity control unit 20 and is then poured out of the pouring nozzle 16.

In FIG. 14(*c*), a cap 23 having first vent holes 31 is further attached through a retaining member 24 to the bottom of the cup-shaped member 19 thereby to provide a double bottom. The content flows having been poured from the first vent holes (passages) 31 such that the content impinges at a right angle upon the outer side of the bottom of the cup-shaped member 19 to have a zero flow velocity in the inflow direction (or in the vertical direction in FIG. 14), so that the content having naturally dropped fills a second flow velocity control unit 25. When this second flow velocity control unit 25 is filled up, the content flows into the first flow velocity control unit 20 from second vent holes 32 formed in the bottom of the cup-shaped member 19. In FIG. 14(*c*), the cylindrical member 26 extends into the cup-shaped member 19, and the arrangement is desirably made such that the content flows from the second vent holes (passages) 32 toward the gap 27 between the cylindrical member 26 and the side wall of the cup-shaped member 19. A sectional diagram of F—F in FIG. 14(*c*) is presented in FIG. 14(*d*). It is essential that the first vent holes 31 and the second vent holes 32 are displaced from each other.

The flow velocity control mechanism thus constructed acts in the following manner.

In embodiments 1 to 3, the content flows having been poured from the vent holes 21 or the slits 22 to impinge upon itself in the vicinity of the center of the flow velocity control unit 20 so that the contents velocity in the inflow direction offsets itself to zero. As a result, the content naturally drops gradually to fill up the flow velocity control unit 20. When the flow velocity control unit 20 is fully filled, the content reaches the pouring nozzle 16 so that it can be poured. Even if the internal pressure is applied by squeezing the container body 2, more specifically, a predetermined time period is necessary until the content reaches the leading end of the pouring nozzle 16. Therefore, even if the container body 2 is carelessly squeezed, the content is not vigorously discharged from the pouring nozzle 16.

In the examples 4 and 5, the flow velocities in the inflow direction are offset to zero not because of the flow of the content poured in the inflow direction impinges upon itself, but because the content flow impinges upon the bottom wall or the like. Especially in the embodiment 4, the flow of the content from the second vent holes 32 impinges again upon the ceiling of the gap 27 between the cylindrical member 26 and the side wall of the cup-shaped member 19 so that the contents velocity drops to zero. As a result, the content having freely dropped fills up the first flow velocity control unit 20 and reaches the pouring nozzle 16. In other words, the content has to pass through the flow velocity control procedures of the two stages before it reaches the pouring nozzle 16. It is, therefore, possible to further increase elongate more the period from the instant when the container body 2 is squeezed to the instant when the content reaches the pouring nozzle 16.

In embodiments 4 and 5, on the other hand, the pouring nozzle 16 extends at its lower end into the cup-shaped member 19. Therefore, even if the self-standing bag-shaped container 1 is inverted upside down, the content does not reach the pouring nozzle 16 until it fills up the gap 27 between the cylindrical member 26 and the side wall of the cup-shaped member 19. It is, therefore, possible to prevent the content from being vigorously discharged when the container is in any position.

Figure 15A:
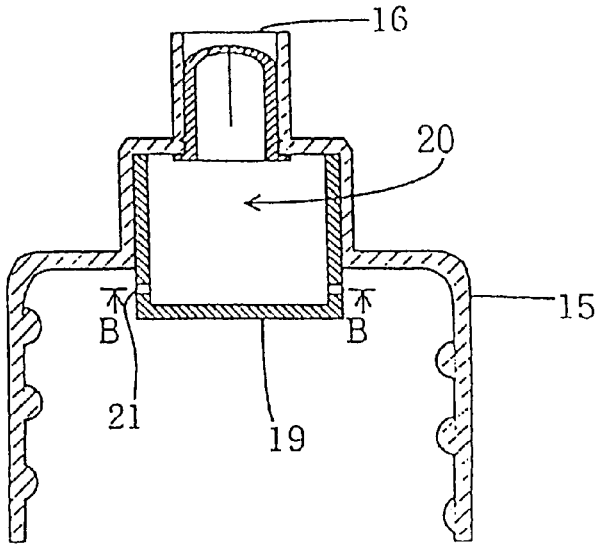
FIGS. 15(*a*) and 15(*b*) are sectional diagrams showing an essential portion of a fourth embodiment.
Figure 15B:
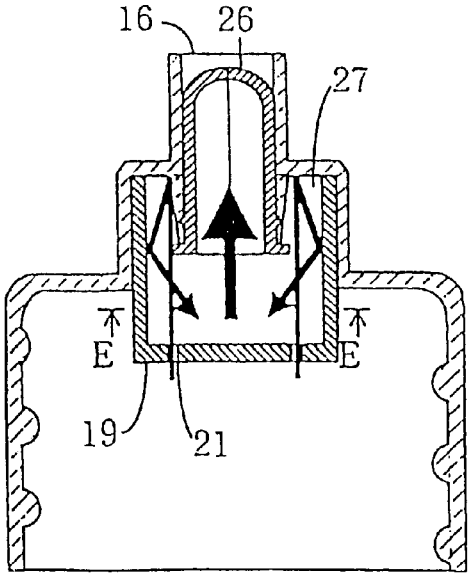

FIGS. 15(*a*) and (*b*) show the individual combinations between the check valve and the flow velocity control valve. Even in a case where a pressure is carelessly applied to the container body 2 so that the content might otherwise spurt, the content does not leak from the container body 2 even without a cover before it fills up the flow velocity control unit 20.

Here, the foregoing embodiments have been premised by applying them to beverages, but can naturally be applied to any liquid that is effected negatively by oxidation. It is feared that a liquid having an extremely low viscosity, such as water, leaks even through a small gap such as a cut in the check valve by the capillary phenomenon. This fear can be alleviated if the container is used in the standing position as in the invention, so that the container can be used independently from the degree of viscosity of the content. In other words, the container can be widely applied not only to viscous fluids other than the beverages, but also to cosmetics or chemicals.

Industrial Applicability

The self-standing container such as the stand pouch of the present invention has the construction thus far described so that it can be optimized for storing not only wine, sake or whiskey, which are negatively effected by contact with air because the content will be oxidized with the air, but also fruit beverages, vegetable juices or other beverages. The invention can provide a vacuum type container which will not lose its self-standing property even if the content is reduced and can stand stably by itself.

It is quite natural that the container like the stand pouch can be used not merely as a disposable container but as the self-standing container in place of the bottle type container which has the pouring port and can be reused. Where the container is used as the self-standing container no matter how much content it has contained therein, it can be kept in the upright position with its bottom being expanded. When the bottle is not used, on the other hand, it can be easily stored in a flat bag shape by folding the bottom.

It is also possible to provide such a soft container represented by the bag-shaped container as is provided with the flow velocity control mechanism for preventing the content from being vigorously discharged by the internal pressure to be generated when the container body is squeezed.

What is claimed is:

1. A container comprising:

a self-standing container body including a wall formed of a soft sheet and a bottom, wherein said bottom is expandable when content is contained within said self-standing container body such that said container stands unaided;

a pouring port disposed at an end portion of said self-standing container;

a check valve mounted in said pouring port, said check valve being operable to open when a pressure within said self-standing container in greater than a pressure outside of said self-standing container and close when the pressure outside of said self-standing container is greater than the pressure within the self-standing container, wherein an inside of said container is evacuated by a vacuum that is established by a weight of the content contained within said self-standing container body; and a joint structure joining said soft sheet with said pouring port, said joint structure comprising a heat-shrinkable first cylindrical sheet in which a portion of said pouring port is inserted and heat shrunk within, and a second cylindrical sheet that is partially heat shrunk within said heat-shrinkable first cylindrical sheet, said second cylindrical sheet including a resin layer fused to said soft sheet and an infusible resin layer located inside said resin layer, wherein said heat-shrinkable first cylindrical sheet is also fused to said soft sheet.

2. A container comprising:

a self-standing container body including a wall formed of a soft sheet and a bottom, wherein said bottom is expandable when content is contained within said self-standing container body such that said container stands unaided;

a pouring port disposed at an end portion of said self-standing container;

a check valve mounted in said pouring port, said check valve being operable to open when a pressure within said self-standing container in greater than a pressure outside of said self-standing container and close when the pressure outside of said self-standing container is greater than the pressure within the self-standing container, wherein an inside of said container is evacuated by a vacuum that is established by a weight of the content contained within said self-standing container body; and a flow velocity control mechanism located between said self-standing container body and said pouring port, said flow velocity control mechanism including a flow velocity control unit having a plurality of passages communicating between said self-standing container body and said flow velocity control mechanism, said plurality of passages being aligned such that the content flowing into said flow velocity control unit from said self-standing container body via said plurality of passages impinges on itself to eliminate a flow velocity of the content.

3. A container-comprising:

a self-standing container body including a wall formed of a soft sheet and a bottom, wherein said bottom is expandable when content is contained within said self-standing container body such that said container stands unaided;

a pouring port disposed at an end portion of said self-standing container;

a check valve mounted in said pouring port, said check valve being operable to open when a pressure within said self-standing container in greater than a pressure outside of said self-standing container and close when the pressure outside of said self-standing container is greater than the pressure within the self-standing container, wherein an inside of said container is evacuated by a vacuum that is established by a weight of the content contained within said self-standing container body; and a flow velocity control mechanism located between said self-standing container body and said pouring port, said flow velocity control mechanism including a flow velocity control unit having a passage and a wall disposed perpendicular and opposite to said passage such that the content flowing into said flow velocity control unit from said self-standing container body via said passage impinges on said wall, eliminating a flow velocity of the content.

4. A container comprising:

a container body including a wall formed of a soft sheet, and a bottom attached to a first end of said wall, said bottom being expandable when content is contained within said container body such that said container stands unaided;

a pouring port comprising a cylindrical member attached to a second end of said wall;

a check valve disposed in said pouring port, said check valve being operable to prevent the backflow of air into said container when the content is discharge from said container, wherein an upper portion of said container is evacuated when said container is stood upright after a portion of the content is discharged by downward migration of a remaining portion of the content due to gravity; and a joint structure joining said soft sheet with said cylindrical member, said joint structure comprising a heat-shrinkable first cylindrical sheet in which a portion of said cylindrical member is inserted and heat shrunk within, and a second cylindrical sheet that is partially heat shrunk within said heat-shrinkable first cylindrical sheet, said second cylindrical sheet including a resin layer fused to said soft sheet and an infusible resin layer located inside said resin layer, wherein said heat-shrinkable first cylindrical sheet is also fused to said soft sheet.

5. A container comprising:

a container body including a wall formed of a soft sheet, and a bottom attached to a first end of said wall, said bottom being expandable when content is contained within said container body such that said container stands unaided;

a pouring port comprising a cylindrical member attached to a second end of said wall;

a check valve disposed in said pouring port, said check valve being operable to prevent the backflow of air into said container when the content is discharge from said container, wherein an upper portion of said container is evacuated when said container is stood upright after a portion of the content is discharged by downward migration of a remaining portion of the content due to gravity; and a flow velocity control mechanism located between said container body and said pouring port, said flow velocity control mechanism including a flow velocity control unit having a plurality of passages communicating between said container body and said flow velocity control mechanism, said plurality of passages being aligned such that the content flowing into said flow velocity control unit from said container body via said plurality of passages impinges on itself to eliminate a flow velocity of the content.

6. A container comprising:

a container body including a wall formed of a soft sheet, and a bottom attached to a first end of said wall, said bottom being expandable when content is contained within said container body such that said container stands unaided;

a pouring port comprising a cylindrical member attached to a second end of said wall;

a check valve disposed in said pouring port, said check valve being operable to prevent the backflow of air into said container when the content is discharge from said container, wherein an upper portion of said container is evacuated when said container is stood upright after a portion of the content is discharged by downward migration of a remaining portion of the content due to gravity; and a flow velocity control mechanism located between said container body and said pouring port, said flow velocity control mechanism including a flow velocity control unit having a passage and a wall disposed perpendicular and opposite to said passage such that the content flowing into said flow velocity control unit from said container body via said passage impinges on said wall, eliminating a flow velocity of the content.

7. A container comprising:

a self-standing container body including a wall formed of a soft sheet and a bottom, wherein said bottom is expandable when content is contained within said self-standing container body such that said container stands unaided;

a pouring port disposed at an end portion of said self-standing container; and a flow velocity control mechanism located between said self-standing container body and said pouring port, said flow velocity control mechanism including a flow velocity control unit having a plurality of passages communicating between said self-standing container body and said flow velocity control mechanism, said plurality of passages being aligned such that the content flowing into said flow velocity control unit from said self-standing container body via said plurality of passages impinges on itself to eliminate a flow velocity of the content.

8. A container comprising:

a self-standing container body including a wall formed of a soft sheet and a bottom, wherein said bottom is expandable when content is contained within said self-standing container body such that said container stands unaided;

a pouring port disposed at an end portion of said self-standing container; and a flow velocity control mechanism located between said self-standing container body and said pouring port, said flow velocity control mechanism including a flow velocity control unit having a passage and a wall disposed perpendicular and opposite to said passage such that the content flowing into said flow velocity control unit from said self-standing container body via said passage impinges on said wall, eliminating a flow velocity of the content.

* * * * *